US008382923B2

(12) United States Patent
Okazaki et al.

(10) Patent No.: US 8,382,923 B2
(45) Date of Patent: Feb. 26, 2013

(54) APPARATUS AND METHOD FOR MANUFACTURING GYPSUM BOARD

(75) Inventors: Shoichi Okazaki, Aichi (JP); Takumi Hatanaka, Tokyo (JP); Ken Hayase, Saitama (JP)

(73) Assignee: Yoshino Gypsum Co., Ltd., Tokyo (JP)

( * ) Notice: Subject to any disclaimer, the term of this patent is extended or adjusted under 35 U.S.C. 154(b) by 476 days.

(21) Appl. No.: 12/451,468

(22) PCT Filed: Apr. 29, 2008

(86) PCT No.: PCT/JP2008/058224

§ 371 (c)(1),
(2), (4) Date: Nov. 13, 2009

(87) PCT Pub. No.: WO2008/149624

PCT Pub. Date: Dec. 11, 2008

(65) Prior Publication Data

US 2010/0132869 A1 Jun. 3, 2010

(30) Foreign Application Priority Data

Jun. 2, 2007 (JP) ..... 2007-147546

(51) Int. Cl.

| | |
|---|---|
| ***B29C 65/00*** | (2006.01) |
| ***B32B 13/00*** | (2006.01) |
| ***B32B 37/00*** | (2006.01) |
| ***B32B 19/00*** | (2006.01) |

(52) U.S. Cl. ..... 156/39; 156/346

(58) Field of Classification Search ..... 156/39, 156/346

See application file for complete search history.

(56) References Cited

U.S. PATENT DOCUMENTS

| | | | | |
|---|---|---|---|---|
| 3,983,775 | A * | 10/1976 | Moore | 83/660 |
| 6,471,799 | B1 | 10/2002 | Sasaki et al. | |
| 6,866,492 | B2 * | 3/2005 | Hauber et al. | 425/96 |

FOREIGN PATENT DOCUMENTS

| | | |
|---|---|---|
| JP | 59-133052 | 7/1984 |
| JP | 2000-71218 | 3/2000 |
| JP | 2002-086424 | 3/2002 |

OTHER PUBLICATIONS

International Preliminary Report on Patentablity for corresponding International Application PCT/JP2008/058224.

* cited by examiner

*Primary Examiner* — Michael Orlando
(74) *Attorney, Agent, or Firm* — Staas & Halsey LLP

(57) ABSTRACT

A gypsum board forming device (10) constitutes an apparatus of producing gypsum boards. A layered formation of a lower sheet (1), an upper sheet (2) and a gypsum slurry (6) passes through a forming gate (40). The forming device forms the formation into a plate-like configuration with use of upper and lower plates (20, 30). The upper plate (20) is constituted from a fixed substrate plate (21) and a movable plate (22), and the movable plate is in surface-to-surface contact with the upper sheet of the layered formation. A plurality of actuators (50) is supported by the substrate plate. Each of the actuators applies an upward or downward load (P) to the movable plate locally for a local deformation of the movable plate owing to a deflection thereof. A gate size (T) is locally changed by displacement of the movable plate relative to the substrate plate.

17 Claims, 10 Drawing Sheets

APPARATUS AND METHOD FOR MANUFACTURING GYPSUM BOARD

CROSS REFERENCE TO RELATED APPLICATIONS

This application claims the benefit under 35 U.S.C. Section 371, of PCT International Application No. PCT/JP2008/058224, filed Apr. 29, 2008, which claimed priority to Japanese Application No. 2007-147546, filed Jun. 2, 2007 in the Japanese Patent Office, the disclosures of which are hereby incorporated by reference.

TECHNICAL FIELD

The present invention relates to apparatus and method of producing gypsum boards, and more specifically, to such apparatus and method achieving improvement of quality and productivity of the gypsum boards by improving adjustability, accuracy and controllability of dimension and configuration of a forming gate defined by the upper and lower plates.

TECHNICAL BACKGROUND

A gypsum board is known as an architectural interior finish material, which has a gypsum core covered with surface cover sheets. The surface cover sheet is exemplified as a sheet of paper for gypsum board liner, a glass fiber mat, a printed paper sheet or fiber mat, an organic resin coated paper sheet or fiber mat, a metal-laminated paper sheet or fiber mat. The gypsum boards are mass-produced by a gypsum board production apparatus, and are circulated in the domestic market of building materials. In general, the gypsum board production apparatus comprises a conveyance device for continuously conveying a sheet of paper for gypsum board liner (a lower sheet) which constitutes a first cover sheet; a scoring device which scores the edge zones of the sheet (lower sheet) on both sides; a mixer for preparation of gypsum slurry; a folding device folding the sheet for forming the edge portions; an upper sheet feeding device for overlaying the gypsum slurry with a sheet of paper for gypsum board liner (an upper sheet) which constitutes a second cover sheet; a forming device forming a layered formation of the upper sheet, the lower sheet and the gypsum slurry into a plate-like configuration; a severing device for severing a predetermined length of board from the plate-like belt formation; a dryer for forced drying of the severed boards containing excess water; a delivery device for cutting the board to be the product of a predetermined size and outputting the products, and so forth.

The forming device constituting the gypsum board production apparatus is known in the art, which causes the layered formation to pass through a forming gate defined by upper and lower plates, so that the upper and lower plates adjust or regulate the thickness of the layered formation passing therethrough (Japanese Patent Publication No. 2-18239 and Japanese Patent Laid-Open Publication No. 2000-71218).

In this kind of forming device, each of the upper and lower plates makes surface-to-surface contact with the layered formation under a considerably high pressure, in order to stabilize the configuration and thickness of the layered formation. Therefore, the upper and lower plates have to endure the heavy forming load acting thereon during the forming process, while maintaining the predetermined gate size. Thus, a thick metal plate with high rigidity is used as each of the upper and lower plates.

Publication 1: Japanese Patent Publication No. 2-18239
Publication 2: Japanese Patent Laid-Open Publication No. 2000-71218

DISCLOSURE OF THE INVENTION

Problem to be Solved by the Invention

The gypsum slurry flowing out from a slurry discharge port of the mixer onto the sheet (lower sheet) does not necessarily have a distributional and directional uniformity, owing to inherent mechanical characteristics of the mixer installed on the apparatus, effect of the property of the slurry, influence of the operating condition, and so forth. Further, the sheet of paper for gypsum board liner does not always have a uniform water absorbing property throughout the overall width of the sheet. Furthermore, the thickness of the gypsum board tends to partially and slightly vary, owing to influence of the volume change and so forth in a curing process of the slurry.

For such reasons, the thickness of the gypsum board partially varies, in accordance with uncertain factors during production of the gypsum boards. Therefore, if the size of the gate between the upper and lower plates is set to be constant throughout the overall width, it is rather difficult to attain uniformity of the thickness of the gypsum board product. The result of this is that the surface smoothness of the gypsum board and so forth is also apt to be degraded. Thus, in order to ensure the thickness uniformity and surface smoothness of the gypsum board products (end products), it is necessary to vary the gate size in the widthwise direction, assuming the thickness and smoothness of the end products beforehand.

However, the plates defining the gate are thick metal plates with high rigidity. Even if the plate can be generally bent in a great curvature, the plate cannot be locally deformed for delicately changing the gate size. It is also difficult to mechanically control the gate size while assuming the condition of the thickness and smoothness of the end products. It is important to improve formability of the edge portion of the gypsum board for improvement of quality of the gypsum board, but it is particularly difficult to finely adjust the size and configuration of the gate for improvement of forming accuracy of the edge portion. In the conventional technique, adjustment of the gate size depends on an adjustment operation manually performed, relying on many years' experience and intuition of a skillful operator. However, in such a method of adjustment, the adjustment can be merely carried out to a limited extent, and therefore, it is quite difficult to realize the optimum size and configuration of the gate adequate to the gypsum board product.

Further, in a case where the gypsum boards different in thickness are produced, or in a case where the gypsum boards different in configuration or size of the edge portion are produced, the size and configuration of the forming gate has to be re-adjusted or re-regulated whenever the type of gypsum board to be produced is changed. Such re-adjustment or re-regulation also depends on the adjustment operation manually performed on the basis of many years' experience and intuition of the skillful operator. Therefore, setting and adjustment operation for a long time is required whenever the type of gypsum board to be produced is changed.

It is an object of the present invention to provide apparatus and method of producing gypsum boards which can achieve improvement of the quality and productivity of the gypsum boards by improving the adjustability, accuracy and controllability of the dimension and configuration of the forming gate defined by the upper and lower plates.

Means for Solving the Problem

The present invention provides an apparatus of producing gypsum boards, which has a forming gate defined by upper and lower plates extending in a crossing direction with respect to a conveyance direction of upper and lower sheets of paper, so that a layered formation, which is constituted from the upper and lower sheets and slurry continuously interposed between the sheets, is passed through said gate to form the layered formation into a plate-like configuration, comprising:

the upper plate constituted from a fixed substrate plate and a movable plate, the movable plate being located below the substrate plate substantially in parallel with the substrate plate so as to be in surface-to-surface contact with the upper sheet; and a plurality of actuators for up-and-down motion supported by said substrate plate, each of the actuators applying an upward or downward load to said movable plate locally for a local deformation thereof owing to a deflection of the movable plate.

The present invention also provides a method of producing gypsum boards, in which a forming gate is defined by upper and lower plates extending in a crossing direction with respect to a conveyance direction of upper and lower sheets of paper, so that a layered formation, which is constituted from the upper and lower sheets and slurry continuously interposed between the sheets, is passed through said gate to form the layered formation into a plate-like configuration, wherein said upper plate is constituted from a fixed substrate plate and a movable plate, the substrate plate extending in the crossing direction with respect to the conveyance direction of said layered formation, and the movable plate being located below the substrate plate substantially in parallel with the substrate plate so as to be in surface-to-surface contact with the layered formation; and wherein an upward or downward load is applied to the movable plate locally for a local deflection of the movable plate by each of actuators for up-and-down motion, the actuators being supported by said substrate plate, so that a size of said gate is locally changed by displacement of the movable plate relative to said substrate plate.

According to the present invention, the upper plate for defining the gate is divided into the fixed substrate plate and the movable plate. The rigidity of the substrate plate can be augmented so that the reaction force against the forming load can be supported by the substrate plate. On the other hand, the rigidity of the movable plate can be reduced so that the deformability of the lower surface of the upper plate is improved. Each of the actuators carried by the substrate plate applies the vertical load on the movable plate locally, thereby causing the movable plate to be locally deformed. Since the substrate plate with high rigidity securely supports the load of the actuator by the reaction force against the vertical load, the movable plate can be deformed in response to the vertical load of the actuator. In the gypsum board production apparatus and method which has or uses the upper plate and the actuator with such arrangements, size and configuration of the gate can be finely and accurately changed by appropriately controlling operation of each of the actuators, and therefore, the adjustability, accuracy and controllability of the dimension and configuration of the gate can be improved, and thus, the quality and productivity of the gypsum boards can be improved. According to results of experiments carried out by the present inventors, with use of a gypsum board production line to which the present invention is applied, the rate of rejects of the products owing to a defective chamfered edge of the board is reduced to one-third or less, and the rate of rejects for a defective thickness of the board is reduced by half, and therefore, the yield rate in production of gypsum boards is remarkably improved.

EFFECTS OR ADVANTAGES TO BE OBTAINED FROM THE INVENTION

The apparatus and method of producing gypsum boards in accordance with the present invention can achieve improvement of the quality and productivity of the gypsum boards by improving the adjustability, accuracy and controllability of the dimension and configuration of the forming gate provided between the upper and lower plates.

BRIEF EXPLANATION OF THE REFERENCE NUMERALS

Figure 1:
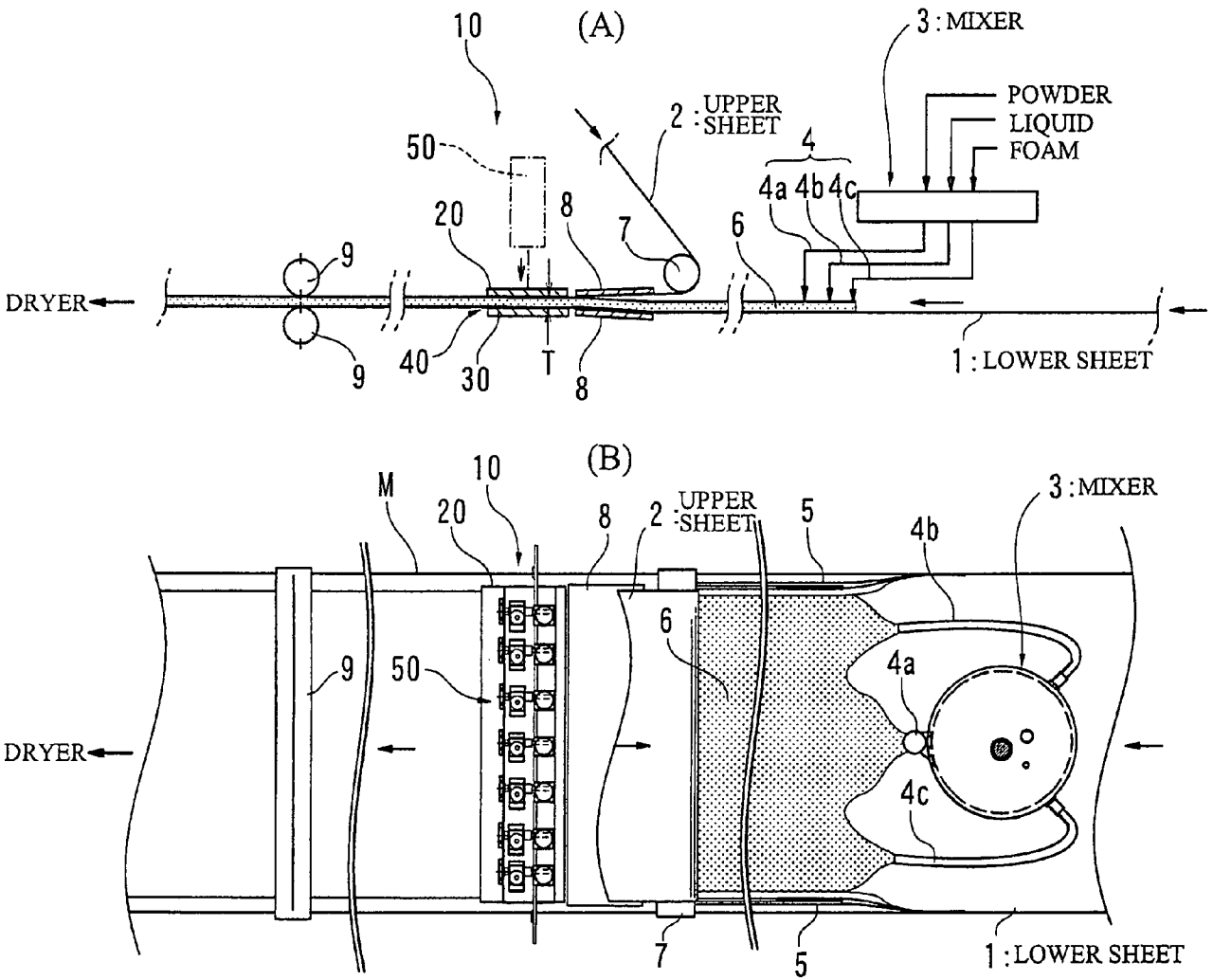
FIG. 1 includes a cross-sectional view and a plan view partially showing a gypsum board production apparatus, wherein a manufacturing process of producing gypsum boards is partially and schematically illustrated.

1 Sheet of Paper for Gypsum Board Liner (Lower Paper)
2 Sheet of Paper for Gypsum Board Liner (Upper Paper)
6 Gypsum Slurry
10 Gypsum Board Forming Device
20 Plate (Upper Plate)
21 Fixed Substrate Plate
22 Movable Plate
30 Plate (Lower Plate)
40 Forming Gate
50 Actuator for Up-and-Down Motion
P Load
T Gate Size

BEST MODE FOR CARRYING OUT THE INVENTION

In a preferred embodiment of the present invention, the actuator may be an electric jack device (linearly actuating mechanism) having an electric motor as a primary drive, or a fluid-operated drive using fluid pressure (hydraulic pressure or pneumatic pressure) as a primary drive. Preferably, the actuating element of the actuator is a reciprocating shaft or rod-like member connected with the movable plate. Alternatively, an actuator with a rodless type drive may be used, such as a rodless cylinder device. If desired, the operation and the load of the actuator may be controlled by direct digital control of an electronic control device such as an electronic computer.

In a preferred embodiment of the present invention, the fixed substrate plate is formed with an opening through which the actuating element of the actuator extends. The actuating element is integrally connected to the movable plate immediately below the opening, so as to transmit the upward or downward load to the movable plate. Provision of such an opening in the substrate plate allows the actuator to be connected with the movable plate without substantially reducing the rigidity of the substrate plate. If desired, a belt-like connection element is fixedly secured on the movable plate, wherein the connection element extends in the conveyance direction of the layered formation. The actuating element is connected with the movable plate by means of the connection element. The belt-like connection element acts to transmit the vertical load of the actuating element to the movable plate uniformly over the depth of the plate.

Preferably, a frame for supporting the actuator is fixed on the substrate plate, and the substrate plate supports the actuator by means of the frame. The reaction force of the actuator is carried by the substrate plate.

In a preferred embodiment of the present invention, the lower surface of the movable plate is horizontal, the axis of the actuating element is vertical, and the load is a vertical load.

In another preferred embodiment of the present invention, the axis of the actuating element is inclined at a predetermined angle with respect to a vertical line. The load acts on the movable plate in a direction of a predetermined angle with respect to the vertical line. The movable plate is so inclined as to make the gate size slightly diverging forward or rearward in the direction of conveyance. The lower surface of the movable plate is angled with respect to a horizontal plane. According to the experiments of the present inventors, the uniformity of the thickness of the gypsum board and the smoothness of the surface of the gypsum board can be further improved in association with the production condition of the gypsum board, in a case where the inclined load acts on the movable plate and the lower surface of the plate is inclined.

According to a preferred embodiment of the present invention, the apparatus includes detecting means for measuring the upward or downward displacement of a local part of the movable plate and a control device into which results measured by the detecting means are input. The control device has operation control means for controlling operation of the actuator and display means for showing the results measured by the detecting means. The control device detects the upward or downward displacement of the local part of the movable plate, and indicates the results on the display device. Preferably, the control device has memory means for memorizing the position of the local part and/or the load of the local part (at least one of the position and the load) in association with the type and thickness of the gypsum board. More preferably, the control device sets target values of the position and/or load of the local part of the movable plate on the basis of the type and thickness of the gypsum board, and carries out automatic control of the actuators in accordance with the target values. Provision of such a control device enables shortening of time required for re-adjustment or re-regulation operation when the type of gypsum board is changed. Also, it enables adjustment of the forming device without depending on the experience of skillful operator. Further, use of such a control device enables standardization of adjustment operation of the forming device, since differences between individuals in manual operation can be eliminated.

Embodiment-1

With reference to the attached drawings, preferred embodiments of the present invention are described hereinafter.

FIG. 1 includes a cross-sectional view and a plan view partially and schematically showing a gypsum board production apparatus, wherein a process of producing gypsum boards is partially and schematically illustrated.

A lower sheet of paper for gypsum board liner 1 is conveyed on a production line of the gypsum board production apparatus. A mixer 3 is located in position above the lower sheet conveyance line. Powder materials (calcined gypsum, adhesive agent, set accelerator, additives, admixture and so forth), foam and liquid (water) are fed to the mixer 3. The mixer 3 mixes these materials and discharges slurry (calcined gypsum slurry) 6 onto the lower sheet 1 through conduits 4 (4*a*, 4*b*, 4*c*). The conduits 4*a* discharges the slurry 6 to a widthwise center zone of the lower sheet 1. The conduits 4*b*, 4*c* discharge the slurry 6 to edge portions (edge zones) of the lower sheet 1 on both sides.

The lower sheet 1 is transferred together with the slurry 6, and side edge portions of the sheet 1 are bent upward by guide members 5. An upper sheet of paper for gypsum board liner 2 is supplied to the slurry 6 by means of a feed roller 7. The lower sheet 1, the slurry 6 and the upper sheet 2 are layered by upper and lower plates 8, and pass through a gypsum board forming device 10 as a continuous three-layered formation of the sheets 1,2 and the slurry 6.

The forming device 10 is provided with upper and lower horizontal plates 20, 30. The lower plate 30 is horizontally fixed to a machine frame M of the gypsum board production apparatus so as to convey the lower sheet 1 horizontally. The upper plate 20 is positioned, vertically spaced at a distance from the lower plate 30. The actuator for up-and-down motion 50 as shown by phantom lines is connected with the upper plate 20. A level of the plate 20 is finely adjusted by the actuator 50. The height (the gate size) T of a forming gate 40 defined between the upper and lower plates 20, 30 is strictly controlled so that suitable forming pressure acts on the layered formation of the sheets 1,2 and the slurry 6. As shown in FIG. 1(B), the plates 20, 30 extend in a direction perpendicular to the conveyance direction of the sheets 1, 2. The layered formation passes through the gate 40, so that it is formed into a continuous belt-like plate with a desired thickness.

The layered formation passing through the forming device 10 travels on the production line toward the following process, while curing reaction of the slurry proceeds during its travel. Severing rollers 9, 9 sever the continuous layered formation having the slurry cured. Boards made by severing the formation are subjected to a forced drying treatment in a dryer (not shown), and then, they are cut to a predetermined product length by a cutting device (not shown) and thereafter, they are transferred to a product delivery line.

Figure 2:
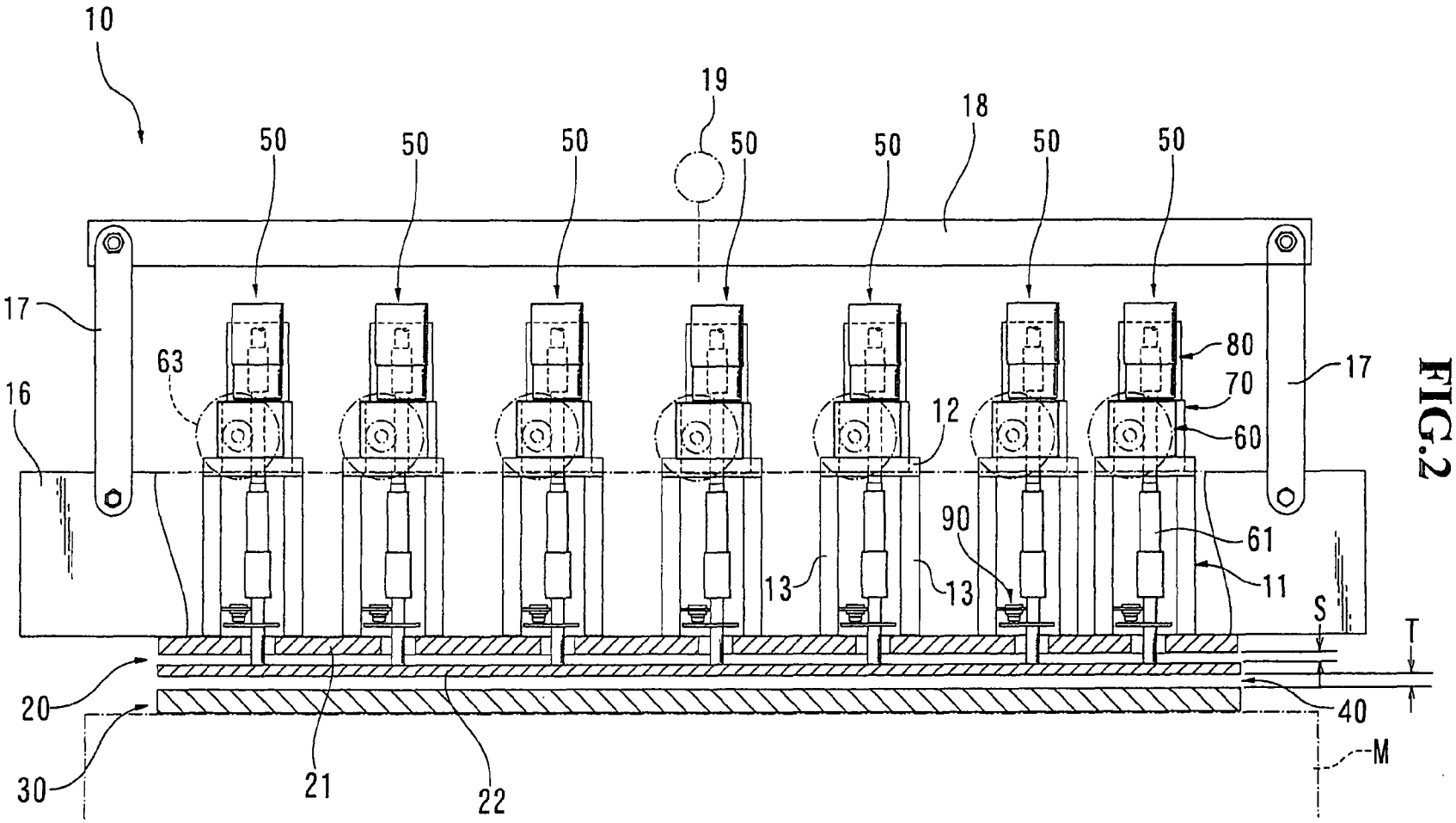
FIG. 2 is a cross-sectional view showing an arrangement of a forming device constituting the gypsum board production apparatus.
Figure 3:
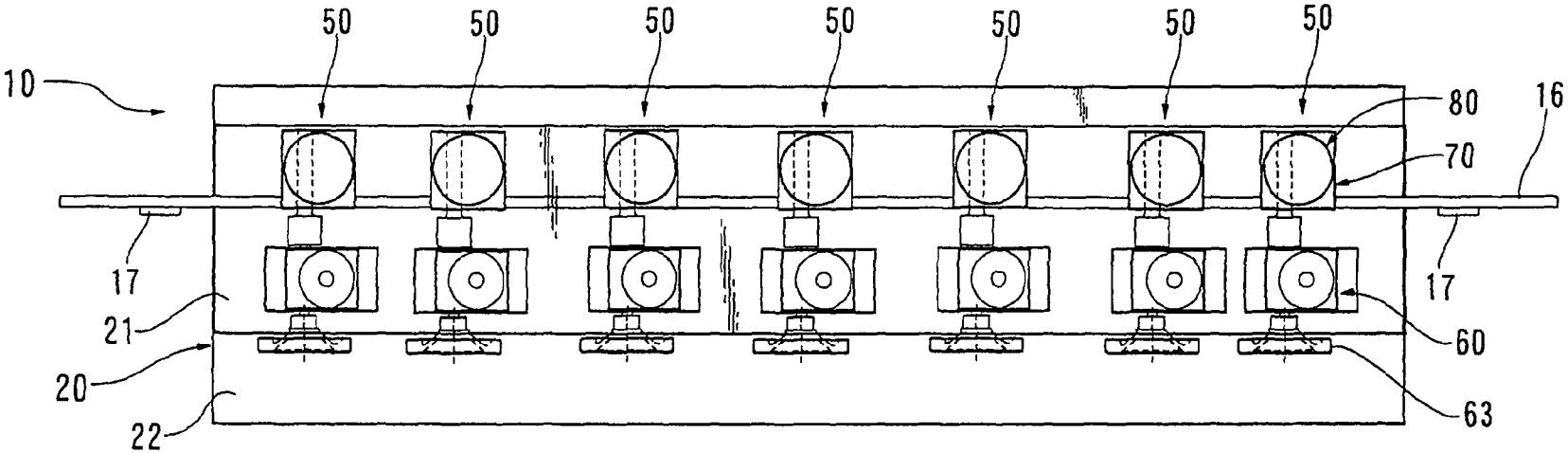
FIG. 3 is a plan view of the forming device as shown in FIG. 2.
Figure 4:
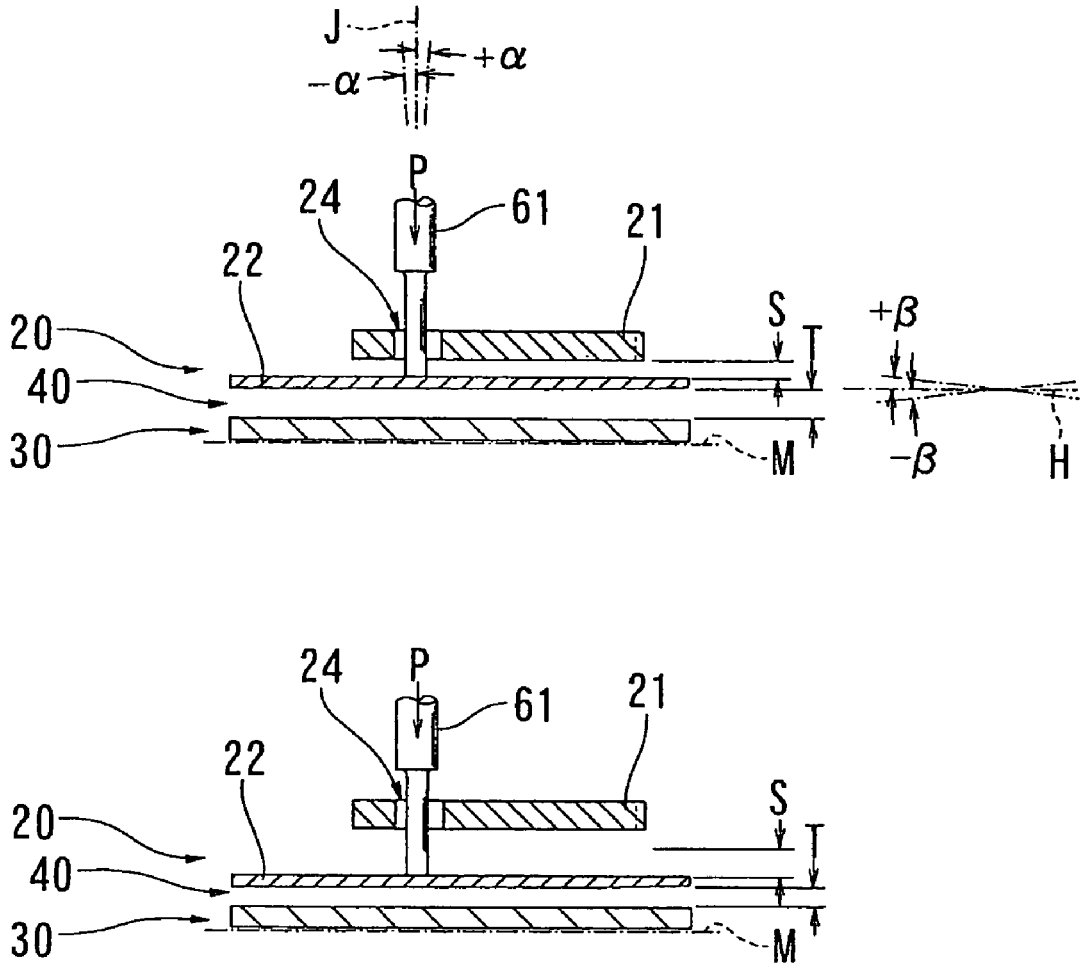
FIG. 4 is a cross-sectional view showing a structure of upper and lower plates defining the forming gate.
Figure 5:
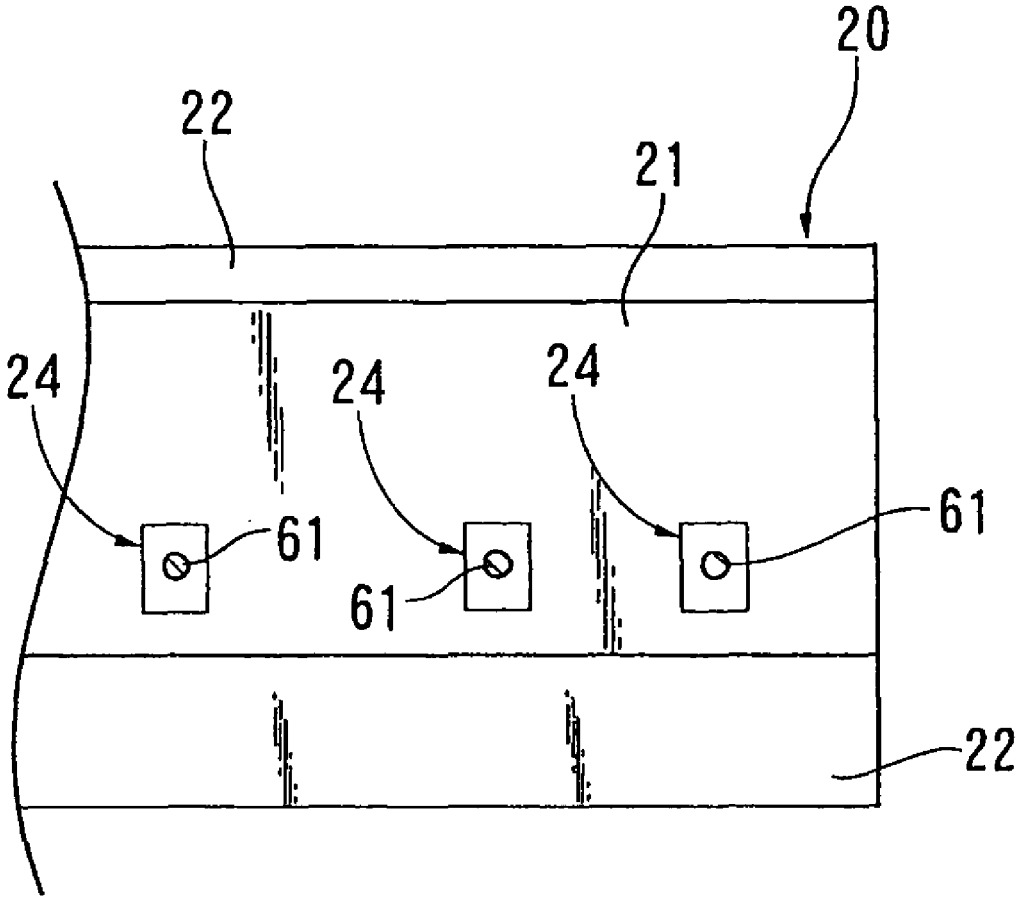
FIG. 5 is a plan view partially showing the upper plate.

FIGS. 2 and 3 are a cross-sectional view and a plan view generally showing the arrangement of the forming device 10. FIG. 4 is a cross-sectional view showing the plates 20, 30 and FIG. 5 is a plan view partially showing the plate 20.

The upper plate 20 of the forming device 10 is divided into a horizontally fixed substrate plate 21 and a horizontal movable plate 22 as shown in FIG. 2. The plate 21 is a metal plate with high rigidity, which is not deformed by a load for forming. The plate 22 is a metal plate with relatively low rigidity, which is apt to be deformed by a vertical load. For instance, the thickness of the plate 21 is set to be not less than 25 mm, whereas the thickness of the plate 22 is set to be equal to or less than 15 mm.

An upper surface of the lower plate 30 is horizontally positioned, spaced at a distance (gate size) T from a lower surface of the movable plate 22. The forming gate 40 is formed by the lower surface of the plate 22 and the upper surface of the plate 30.

The fixed substrate plate 21 is fixedly secured to a vertical carrier plate 16 traversing the gypsum board production apparatus. Both end portions of the carrier plate 16 are suspended from a horizontal beam 18 by a pair of right and left vertical supports 17. The beam 18 is suspended from an upper frame (not shown) of the apparatus by means of a center suspender 19 (shown by phantom lines). Alternatively, a lower frame (machine frame M) of the apparatus may bear the end portions of the plate 16. In FIG. 2, only end portions of the plate 16 are depicted by solid lines, and the center part of the plate 16 is shown by phantom lines.

The forming device 10 has a plurality of actuators 50. Frames 11, each supporting each of the actuators 50, are disposed on the fixed substrate plate 21. The frame 11 is constituted from right and left vertical supports 13 in a pair and a horizontal carrier plate 12, which is joined to top ends of the supports 13. Bottom ends of the supports 13 are fixed to the plate 21.

The actuators 50 are positioned, spaced at a predetermined interval in the widthwise direction of the gypsum board production apparatus. Each of the actuators 50 comprises a jack device (a linearly actuating mechanism) 60 installed on the carrier plate 12, a reduction gear device 70 connected with the jack 60, and an electric motor 80 connected with the device 70. The motor 80 is a primary drive.

Figure 6:
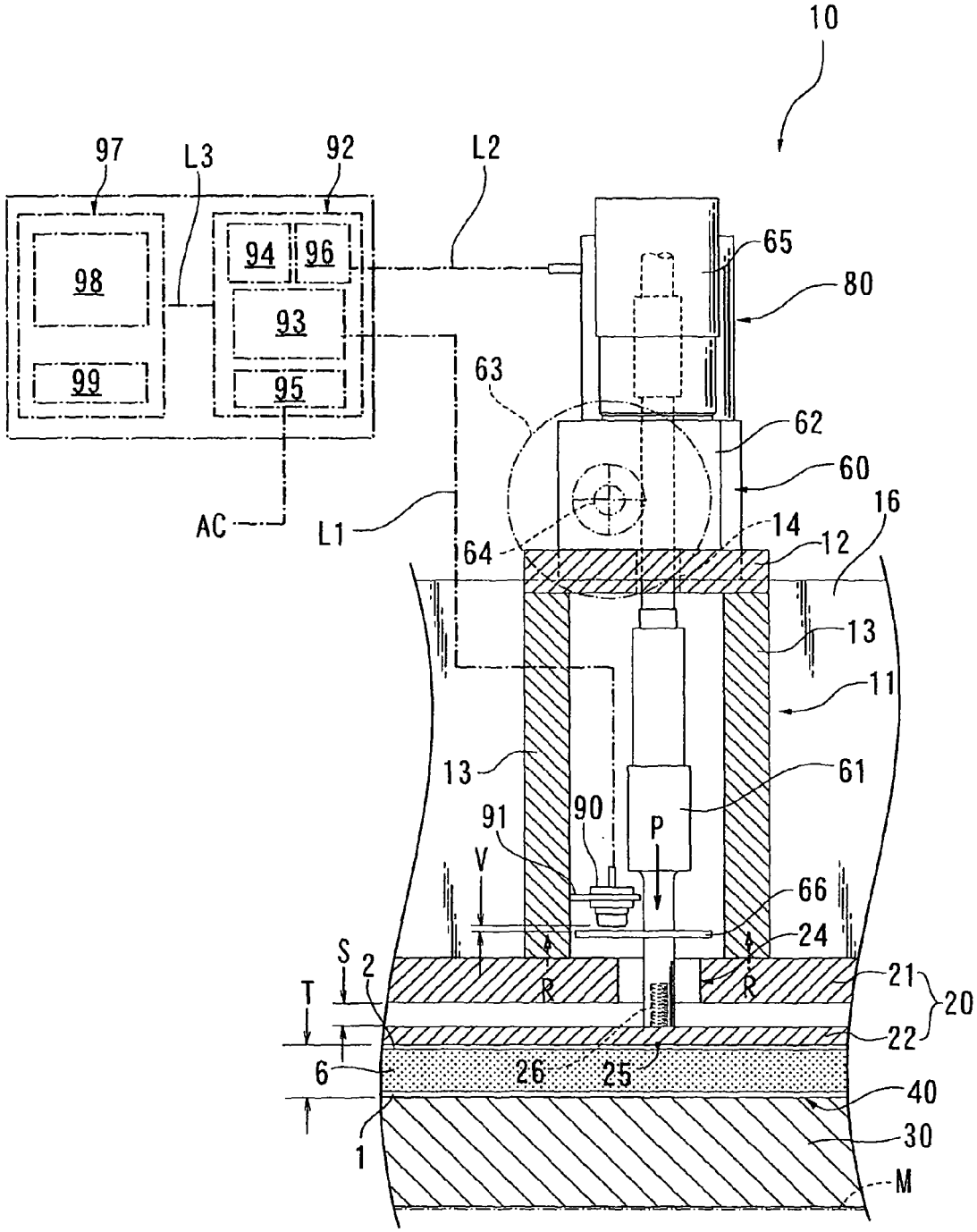
FIG. 6 is a cross-sectional view showing structures of the plates and an actuator for up-and-down motion.
Figure 7:
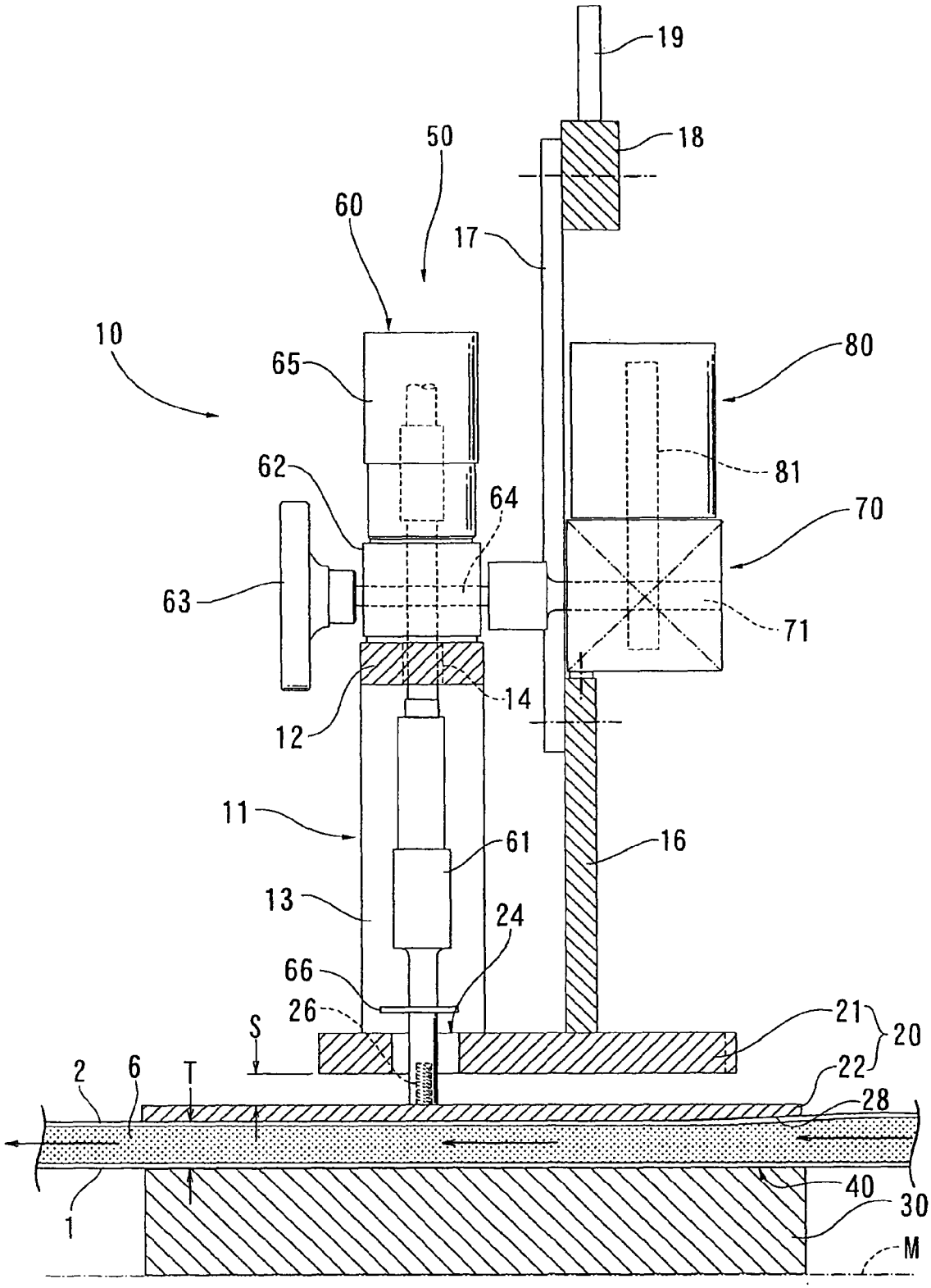
FIG. 7 is another cross-sectional view showing the structures of the plates and the actuator.
Figure 8:
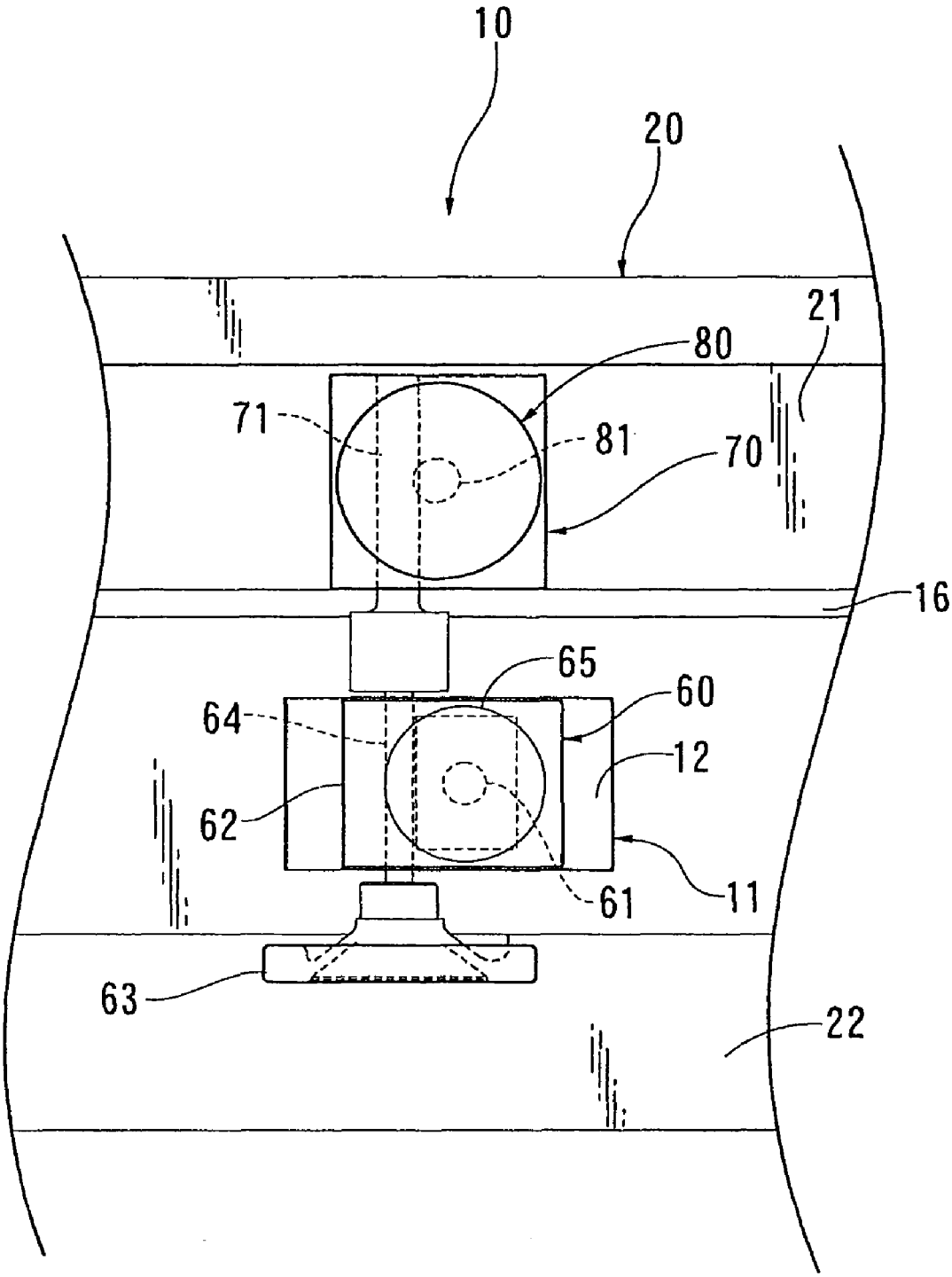
FIG. 8 is a plan view showing the structures of the plates and the actuator.

FIGS. 6, 7 and 8 are cross-sectional views and a plan view showing the structures of the plates 20, 30 and the actuator 50.

The jack device 60 is provided with a gear case 62 fixed on the upper surface of the carrier plate 12, a vertical actuator shaft 61 depending from the case 62, and a manually operable handle 63 for manually setting a vertical position of the shaft 61. The shaft 61 is operatively connected with a horizontal input shaft 64 by means of a power transmission gear mechanism (not shown) contained in the case 62. The input shaft 64 is concentrically connected with a horizontal output shaft 71 of the reduction gear device 70. The output shaft 71 is operatively connected with a vertical output shaft (rotary drive shaft) 81 of the motor 80 by means of a power transmission gear mechanism (not shown) in the device 70.

An upper part of the actuator shaft 61 extends into an upper part 65 of the gear case, and a lower part of the shaft 61 extends vertically downward through an opening 14 of the plate 12. The substrate plate 21 is formed with an opening 24, through which the lower end portion of the shaft 61 can extend. The shaft 61 vertically extends through the opening 24. A stud bolt 26 fixed on the movable plate 22 is screwed into a threaded hole formed at a lower end of the shaft 61. The shaft 61 and the movable plate 22 are integrally connected with each other by the stud bolt 26. Alternatively, the lower end portion of the shaft 61 may be welded to the movable plate 22, or the lower end portion of the shaft 61 may be screwed, bolted or welded on or to a horizontal belt-like connection element secured to an upper surface of the movable plate 22. In the latter case, the shaft 61 is connected to the movable plate 22 by means of the connection element.

The reduction gear device 70 augments the torque of the electric motor 80. The jack device 60 converts a rotary motion of the output shaft 71 to a vertical motion of the actuator shaft 61. As shown in FIG. 6, a vertical load P of the actuator shaft 61 acts on the movable plate 22. The load P causes vertical displacement of an actuated point (a local portion) 25 of the movable plate 21, the actuated point 25 being located directly below the shaft 61. A reaction force R against the load P acts on a base part of the vertical support 13. The reaction force R is carried by the fixed substrate plate 21.

The lower surface of the substrate plate 21 and the upper surface of the movable plate 22 are vertically spaced at a distance S. The upper surface of the lower plate 30 and the lower surface of the movable plate 22 are vertically spaced at a distance T. As shown in FIG. 7, an edge portion of the movable plate 22 on its receiving side is formed with a tapered lower surface 28 in order to receive the layered formation smoothly.

When the actuator shaft 61 is displaced vertically downward as shown in FIGS. 4 (A) and 4 (B), the movable plate 22 is pressed by the shaft 61 so that a downward deflection is locally caused. As the result, the space (the gate size) T is reduced. On the contrary, when the shaft 61 is displaced vertically upward, restoration of the deflection of the movable plate 22 or upward deflection of the plate 22 is caused, in response to change of the load acting on the plate 22. Thus, the space (the gate size) T is increased.

As shown in FIG. 6, a distance sensor 90 for detecting the change of the space (the gate size) T is attached to the support 13. The sensor 90 is fixedly secured to the support 13 by means of a horizontal bracket 91. A measured plate 66 is horizontally fixed to the actuator shaft 61, wherein the plate 66 opposes against a detector element of the sensor 90.

The distance sensor 90 detects the distance V between the detector element and the plate 66. A measured value (the distance V) of the sensor 90 is input to the control unit 92 through a signal line L1. A control section 93 in the unit 92 recognizes the measured value (the distance V) as an indication of the position of the actuated point 25, and a memory section 94 in the unit 92 memorizes the measured value of the sensor 90. A power supply section 95 in the unit 92 is connected to the AC power supply. A driver section 96 of the unit 92 feeds electric power to the electric motor 80 of each of the actuators 50 through a power supply line L2. The driver section 96 also controls the operation of the motor 80. The unit 92 is connected with a control panel 97 by means of a control signal line L3. The control panel 97 allows its display 98 to show the level (height) of the actuated point 25 detected by the sensor 90. Further, the control panel 97 is provided with an operating section 99 for manually setting a target level (target height) of the actuated point 25 for each of the actuators 50. A control system including the control unit 92 and the control panel 97 constitutes control means for the forming device 10.

The operation of the forming device 10 is described hereinafter.

The layered formation of the lower sheet 1, the slurry 6 and the upper sheet 2 is regulated in its thickness by the gate 40 of the forming device 10, as shown in FIG. 1. However, in order to obtain the gypsum board products (end products) having a constant thickness throughout its overall width, it is not necessarily desirable to set the dimension T of the gate 40 to be a constant value throughout the overall width of the gate 40.

The reason why is considered to be as follows:

(1) The slurry 6 discharged on the lower sheet 1 through the conduits 4*a*, 4*b*, 4*c* does not necessarily have a distributional and directional uniformity, owing to an inherent mechanical characteristic of the mixer 3 or difference of operating condition of the mixer 3;

(2) The lower and upper sheets 1, 2 does not necessarily have a uniform water absorbing property throughout the overall width of the sheets; and (3) In the succeeding drying and curing step, drying and curing characteristic of an edge portion of the gypsum board differs from that of a center part of the gypsum board.

Therefore, it is desirable to delicately change the gate size T in the widthwise direction in order to attain a uniform thickness distribution of the gypsum board product (the end product), wherein the gate size T is intentionally ununiformed for the uniform thickness distribution of the gypsum board product.

Further, gypsum boards with edge portions intentionally reduced in thickness are often produced. In production of such a type of gypsum board, the thickness of the board has to be changed in its widthwise direction, or the board has to be formed so that the thickness of the board is partially reduced. In such a case, it is necessary to makes the gate size T ununiformed intentionally.

Figure 9:
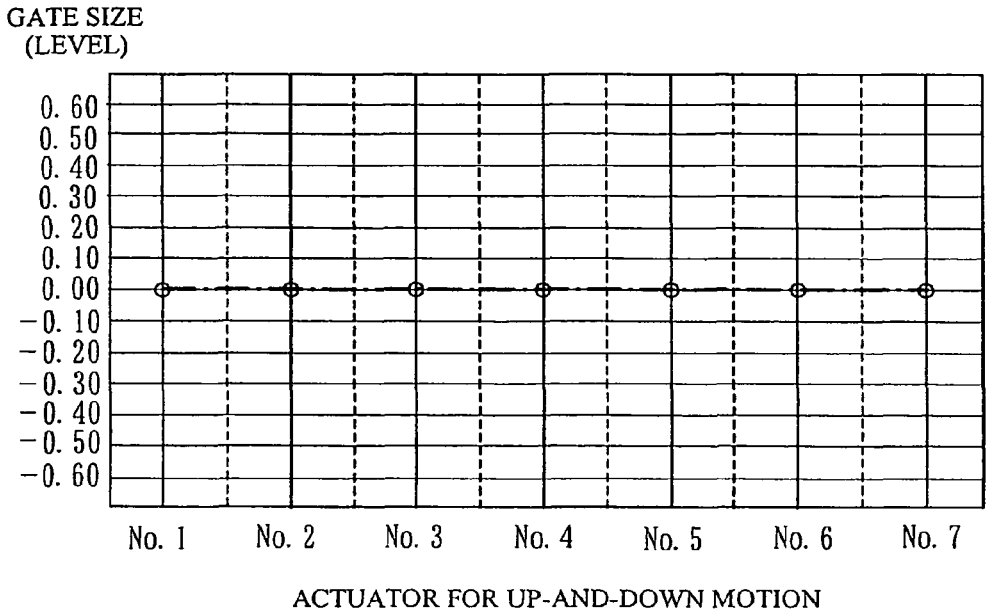
FIG. 9 is a front elevational view of indications on a display of a control panel, wherein levels of actuated points are exemplified.
Figure 10:
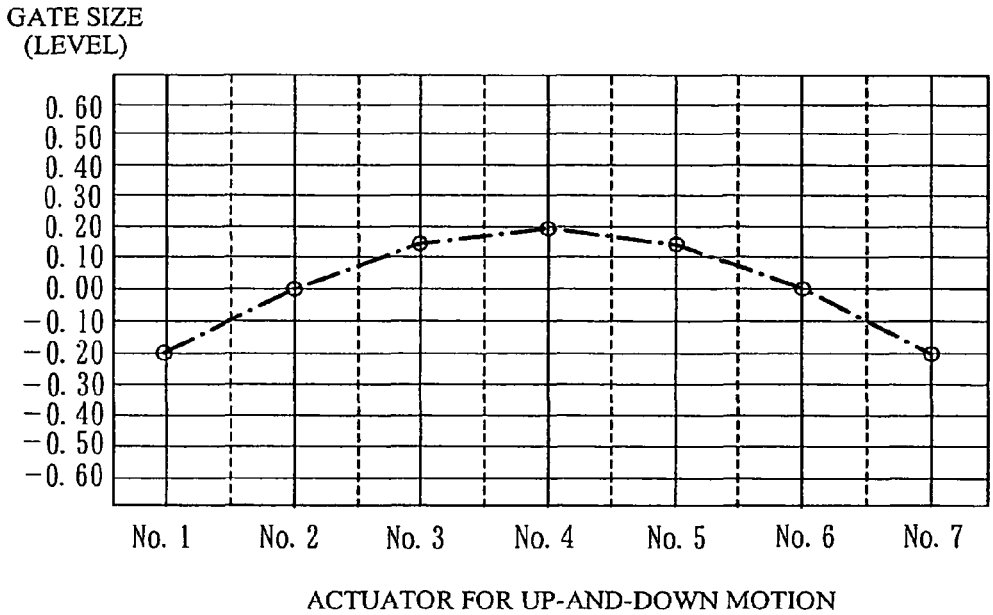
FIG. 10 is a front elevational view of the indications on the display, in which another example of the levels of the actuated points is shown.
Figure 11:
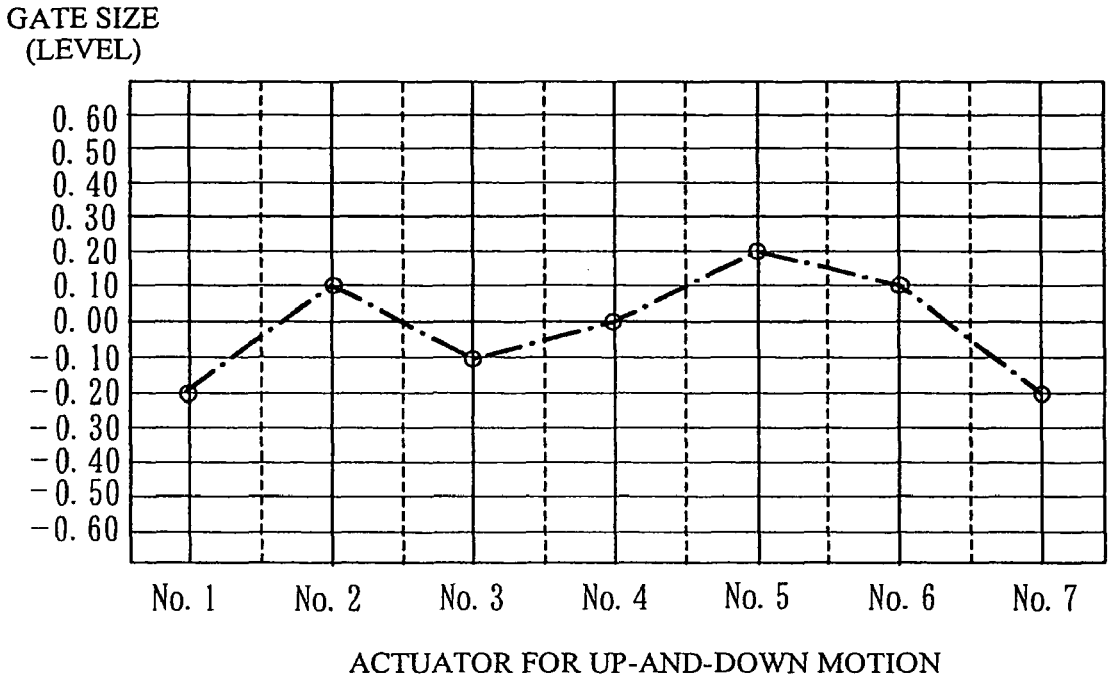
FIG. 11 is a front elevational view of the indications on the display, in which yet another example of the levels of the actuated points is shown.

In FIGS. 9 to 11, levels of the actuated points 25 indicated on the display 98 of the control panel 97 are exemplified. In this embodiment, the forming device 10 has the seven actuators 50, and therefore, the results obtained by detection of the seven distance sensors 90 are indicated on the display 98 as the levels of the seven actuated points 25. In an initial condition as shown in FIG. 9, all of the actuated points 25 (No. 1-No. 7) are represented at a reference level (0.00), and the gate size T is set to be constant throughout the overall width.

When the target level of each of the actuated points 25 is set by manual operation of the operating section 99, the control unit 92 operates the electric motor 80 of each of the actuators 50, so that each of the actuators 50 displaces the actuator shaft 61 vertically. For instance, if the target level of the point 25 is lowered for reducing the gate size T, the shaft 61 displaces the point 25 (FIG. 6) of the movable plate 22 vertically downward as shown in FIG. 4(B), whereby the gate size T at the point 25 is locally reduced. On the other hand, if the target level of the point 25 is raised for increasing the gate size T, the shafts 61 displaces the point 25 of the movable plate 22 vertically upward, whereby the gate size T at the point 25 is locally enlarged. As the results of such operation, the levels of the points 25 of No. 1 to No. 7 vary as exemplified in FIG. 10. The movable plate 22, which is a relatively flexible metal plate with low rigidity, can be transformed into a generally parabolic curve. The plate 22 can be transformed into not only such a simple curved form but also an arbitrary curved form, such as a wave form having a locally inverted portion as shown in FIG. 11. If desired, the handle 63 may be manually operated to adjust the position of the shaft 61 for a fine adjustment of the level of the point 25.

The control unit 92 (FIG. 6) also has a function of readily setting the gate size T on the basis of past data. The memory section 94 of the unit 92 memorizes the data of the gate size T optimum in relation to the type and thickness of gypsum board, as a production pattern. The operating section 99 has selecting means for selecting a specific type and thickness of gypsum board. When the type and thickness of gypsum board is selected by the operating section 99, the control section 93 of the unit 92 reads the past pattern stored in the memory section 94, and then, sets the optimum values of the gate size T corresponding to the type and thickness of gypsum board, as being the target values, and further, carries out automatic control of each of the actuators 50.

Embodiment-2

In the embodiment as set forth above, the lower surface of the movable plate 22 is horizontal, an axis of the actuator shaft 61 is vertical, and the load P is a vertical load. However, results of experiments by the present inventors reveal that, in a case where the load P obliquely acts on the plate 22 as an angled load and the lower surface of the plate 22 is also inclined, the uniformity of the thickness of gypsum board and the smoothness of the surface of gypsum board can be often improved under some production conditions of the gypsum boards.

As illustrated in FIG. 4, the center line of the shaft 61 is inclined at a predetermined angle of $\pm\alpha$ with respect to a vertical line J, and the load P acts on the movable plate 22 in a direction of the angle of $\pm\alpha$. The plate 22 is inclined at a predetermined angle of $\pm\beta$ with respect to a horizontal plane H, and the lower surface of the plate 22 is so inclined as to reduce (convergently) or enlarge the gate size T forward in the direction of conveyance (downstream side).

For instance, such an inclination of the shaft 61 and the plate 22 may be set by generally inclining the forming device 10 at the time of installation of the device 10 on the gypsum board production apparatus.

As a modification, it is possible to incline only the center line of the shaft 61, while the plate 22 is kept in its horizontal position. As another modification, it is possible to incline the center lines of the shafts 61 with regard to some of the actuators 50, while the center lines of the shafts 61 of the remaining actuators 50 are kept in their vertical positions.

Although the present invention has been described as to preferred embodiments, the present invention is not limited thereto, but may be carried out in any of various modifications or variations without departing from the scope of the invention as defined in the accompanying claims.

For insurance, although the forming device is provided with the seven actuators in the aforementioned embodiments, the number of actuators and the positions of the actuators may be appropriately changed in accordance with the condition of use and the structure of the production apparatus or the forming device.

Further, although the electric power motor is used as the primary drive of the vertical actuator in the aforementioned embodiments, the vertical actuator may be driven by hydraulic or pneumatic power source or the like.

Furthermore, the forming device may be further provided with means for detecting the load, such as a load cell, in order to detect the load acting on the vertical actuator shaft.

Industrial Applicability

The present invention is applied to the apparatus of producing the gypsum boards, in which the thickness of the layered formation of the upper and lower sheets and the gypsum slurry is regulated with use of the forming gate defined by the upper and lower plates, so that the formation is formed to a plate-like configuration. The present invention is also applied to the method of producing the gypsum boards with use of such an apparatus. According to the present invention, improvement of quality and productivity of the gypsum boards can be achieved by improving adjustability, accuracy and controllability of dimension and configuration of a forming gate made by the upper and lower plates.

The invention claimed is:

1. An apparatus for producing gypsum boards, comprising:

a forming device forming a layered formation into a plate-like configuration by a forming pressure, the layered formation being constituted by an upper sheet of paper, a lower sheet of paper and a slurry continuously interposed between the sheets, and the forming device including:

a forming gate defined by upper and lower plates which extend in a crossing direction with respect to a conveyance direction of the upper and lower sheets and which are in surface-to-surface contact with the layered formation under the forming pressure, so that the layered formation is passed through said gate to impose the forming pressure on the layered formation by the upper and lower plates, in order to stabilize a configuration and a thickness of the layered formation, the upper plate being divided into a fixed substrate plate and a movable plate separated from the fixed substrate plate, the fixed substrate plate being a metal plate with high rigidity, the movable plate being a metal plate with relatively low rigidity, and the movable plate being located below the fixed substrate plate substantially in parallel with the fixed substrate plate so as to be in surface-to-surface contact with the upper sheet of the layered formation;

a plurality of actuators for up-and-down motion, are carried on and supported by the fixed substrate plate wherein each of the actuators locally applies an upward or downward load to said movable plate for a local deformation thereof owing to a deflection of the movable plate, so that the forming pressure acts on the layered formation by the locally deflected movable plate in surface-to-surface contact with the upper sheet of paper means for supporting a reaction force of each of the actuators by the fixed substrate plate.

2. The apparatus as defined in claim 1, wherein the fixed substrate plate is formed with an opening through which an actuating element of one of the actuators extends, and the actuating element is integrally connected with said the movable plate immediately below the opening, so as to transmit the load to the movable plate.

3. The apparatus as defined in claim 1, further comprising:

detecting means for detecting upward or downward displacement of a local part of the movable plate; and a control device into which results detected by the detecting means are input, wherein the control device includes operation control means for controlling operation of the actuators, and display means for showing the results detected by the detecting means.

4. The apparatus as defined in claim 3, wherein said control device includes memory means for memorizing positions and/or loads of the local parts of the movable plate in association with type and thickness of the gypsum board.

5. The apparatus as defined in claim 4, wherein said control device sets target values of the position and/or load of the local part of the movable plate in accordance with manual setting of the type and thickness of the gypsum board, and carries out control of said actuators on the basis of the target values.

6. The apparatus as defined in claim 1, wherein a lower surface of said movable plate is horizontal, an axis of an actuating element of each of said actuators is vertical, and said load is a vertical load.

7. The apparatus as defined in claim 1, wherein an axis of an actuating element of each of said actuators is inclined at a predetermined angle with respect to a vertical line, and said load acts on said movable plate in a direction inclined at a predetermined angle with respect to the vertical line.

8. The apparatus as defined in claim 7, wherein a lower surface of said movable plate is inclined at a predetermined angle with respect to a horizontal plane.

9. A method of producing gypsum boards, comprising:

defining a forming gate by upper and lower plates of a forming device, which extend in a crossing direction with respect to a conveyance direction of upper and lower sheets of paper and which are brought into surface-to-surface contact with a layered formation under a forming pressure, the layered formation being constituted from the upper and lower sheets and a slurry continuously interposed between the sheets;

passing the layered formation through the gate to impose a forming pressure on the layered formation by the upper and lower plates, in order to stabilize a configuration and a thickness of the layered formation, thereby forming the layered formation into a plate-like configuration by the forming pressure, dividing the upper plate into a fixed substrate plate and a movable plate separated from the fixed substrate plate, the fixed substrate plate being a metal plate with high rigidity, the movable plate being a metal plate with relatively low rigidity, and the fixed substrate plate extending in the crossing direction with respect to the conveyance direction of the layered formation;

locating the movable plate below the fixed substrate plate substantially in parallel with the fixed substrate plate so as to be in surface-to-surface contact with the upper sheet of the layered formation;

locally applying an upward or downward load to the movable plate for a local deflection of the movable plate by each of a plurality of actuators for up-and-down motion, the actuators being carried on and supported by the fixed substrate plate, so that a size of the gate is locally changed by displacement of the movable plate relative to the fixed substrate plate, thereby causing the forming pressure to act on the layered formation with the locally deflected movable plate being in surface-to-surface contact with the upper sheet; and supporting a reaction force of the actuator by the fixed substrate plate.

10. The method as defined in claim 9, further comprising:

detecting a displacement and/or load of an actuating element of each of the actuators;

displaying the displacement of an actuator shaft in a display section of a control device; and storing a position and/or load of the actuator shaft is in a memory section of the control device.

11. The method as defined in claim 10, further comprising;

preliminarily storing a position and/or load of each of the actuating elements suitable for type and thickness of the gypsum board in the memory section; and carrying out automatic control of the actuators in accordance with setting of the type and dimension of the gypsum board.

12. The method as defined in claim 9, wherein the load is a vertical load.

13. The method as defined in claim 9, further comprising applying the load to the movable plate in a direction inclined at a predetermined angle with respect to a vertical line.

14. The apparatus as defined in claim 1, further comprising upper and lower plates located on an upstream side of said forming device in the conveyance direction in order to continuously feed the sheets and the slurry to said forming device as a continuous three-layered material of the sheets and the slurry.

15. The method as defined in of claims 9, wherein the lower sheet, the slurry and the upper sheet are layered by upper and lower plates located on an upstream side of the forming device in the conveyance direction, in order to continuously feed the sheets and the slurry to the forming device as a continuous three-layered material of the sheets and the slurry.

16. The apparatus as defined in claim 2, further comprising upper and lower plates located on an upstream side of said forming device in the conveyance direction in order to continuously feed the sheets and the slurry to said forming device as a continuous three-layered material of the sheets and the slurry.

17. The method as defined in of claims 10, wherein the lower sheet, the slurry and the upper sheet are layered by upper and lower plates located on an upstream side of the forming device in the conveyance direction, in order to continuously feed the sheets and the slurry to the forming device as a continuous three-layered material of the sheets and the slurry.

* * * * *

UNITED STATES PATENT AND TRADEMARK OFFICE

CERTIFICATE OF CORRECTION

PATENT NO. : 8,382,923 B2
APPLICATION NO. : 12/451468
DATED : February 26, 2013
INVENTOR(S) : Shoichi Okazaki et al.

It is certified that error appears in the above-identified patent and that said Letters Patent is hereby corrected as shown below:

Title Page, Column 2 (Other Publications); Line 1, Delete "Patentablity" and insert --Patentability--, therefor.

In the Claims

Column 13, Line 4, In Claim 15, delete "of claims" and insert --claim--, therefor.
Column 14, Line 4, In Claim 17, delete "of claims" and insert --claim--, therefor.

Signed and Sealed this
Eleventh Day of June, 2013

Teresa Stanek Rea
*Acting Director of the United States Patent and Trademark Office*